US008553056B2

(12) United States Patent
Hanabusa

(10) Patent No.: US 8,553,056 B2
(45) Date of Patent: Oct. 8, 2013

(54) IMAGE RECORDING APPARATUS

(75) Inventor: Akira Hanabusa, Kanagawa (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/459,770

(22) Filed: Apr. 30, 2012

(65) Prior Publication Data

US 2012/0293594 A1 Nov. 22, 2012

(30) Foreign Application Priority Data

May 16, 2011 (JP) ..... 2011-109634

(51) Int. Cl.
*B41J 2/32* (2006.01)

(52) U.S. Cl.
USPC ..... 347/197

(58) Field of Classification Search
USPC ..... 347/197, 198; 400/120.16, 120.17; 250/208.1
See application file for complete search history.

(56) References Cited

U.S. PATENT DOCUMENTS

| | | | |
|---|---|---|---|
| 5,942,745 | A | 8/1999 | Kline et al. |
| 2002/0012153 | A1 | 1/2002 | Sunagawa |
| 2002/0015088 | A1 | 2/2002 | Inoue et al. |
| 2002/0154207 | A1 | 10/2002 | Beier et al. |
| 2002/0196325 | A1 | 12/2002 | Pierson |
| 2003/0142194 | A1 | 7/2003 | Inoue et al. |
| 2003/0148218 | A1 | 8/2003 | Mori |
| 2004/0240922 | A1 | 12/2004 | Oka et al. |
| 2007/0224527 | A1 | 9/2007 | Ogawa et al. |

FOREIGN PATENT DOCUMENTS

| | | |
|---|---|---|
| EP | 0945276 | 9/1999 |
| EP | 1147906 | 10/2001 |
| EP | 1235111 | 8/2002 |
| EP | 1266751 | 12/2002 |
| EP | 1844942 | 10/2007 |
| JP | 2007-253520 | 10/2007 |
| WO | 92/08313 | 5/1992 |

OTHER PUBLICATIONS

Search report from E.P.O., mail date is Jul. 26, 2012.

*Primary Examiner* — Kristal Feggins
(74) *Attorney, Agent, or Firm* — Greenblum & Bernstein, P.L.C.

(57) ABSTRACT

An image recording apparatus includes a recording head connected to a plurality of laser emitters provided in a line; a linear motor displacing the recording head in a secondary scanning direction; and an apparatus controller controlling the emission of laser light from the recording head and displacement of the recording head by the displacer. In response to rotation of a drum, one cycle of scanning by the recording head in a main scanning direction of a plate is completed. For each drum rotation, the apparatus controller displaces the recording head in the secondary scanning direction by displacement amount smaller than the recording width in the secondary scanning direction according to laser light emitted from the plurality of laser emitters.

19 Claims, 12 Drawing Sheets

IMAGE RECORDING APPARATUS

CROSS-REFERENCE TO RELATED APPLICATIONS

The present application claims priority under 35 U.S.C. §119 of Japanese Application No. 2011-109634, filed on May 16, 2011, the disclosure of which is expressly incorporated by reference herein in its entirety.

BACKGROUND OF THE INVENTION

1. Field of the Invention

The present invention relates to an image recording apparatus which records an image by irradiating laser light onto a recording medium such as a plate wrapped around a drum.

2. Description of Related Art

Conventionally, technology exists to improve a recording strength of a laser light irradiating a recording region on a plate (such as a flexographic plate, a letterpress plate, and the like) used in CTP (Computer to Plate) printing in order to reliably record an image on the plate.

A known example of the conventional technology of this type is an image recording apparatus including a displacer and a controller controlling the displacer, the displacer relatively displacing a recording head having a laser light source in a main scanning direction (drum circumferential direction) and a secondary scanning direction (drum axial direction) with respect to a recording medium. The controller controls the displacer.

As shown in FIG. 12, when image recording is performed on a heat-reactive plate P, (such as a thermal CTP plate, a flexographic CTP plate, and the like) using a recording head (not depicted) having a plurality of laser light sources lined up at predetermined intervals, the recording strength (that is, thermal energy) becomes reduced at two edges Pe in the secondary scanning direction (that is, an alignment direction of the laser light (channel (ch) numbers 1 through n) irradiating the plate P shown in FIG. 12) of the recording head as compared to a center Pc where the laser light is co-adjacent (i.e., the laser beams are adjacent to other laser beams on both sides). Thus, there is a situation where irregularities formed on a surface of the plate P become smaller and banding occurs in a printed image.

Related Art: Japanese Patent Laid-open Publication No. 2007-253520

SUMMARY OF THE INVENTION

The present invention is conceived in view of such situations in the conventional technology, and has as an advantage of providing an image recording apparatus that prevents a reduction in recording strength at both edges of the recording head and thus effectively inhibits the occurrence of banding in a printed image.

The image recording apparatus of the present invention performs image recording by irradiating laser light onto a heat-reactive recording medium wrapped around a drum. The image recording apparatus includes a recording head coupled to a plurality of laser emitters provided in a line and emitting laser light; a displacer displacing the recording head in a secondary scanning direction intersecting with a main scanning direction in which the recording medium is wrapped around the drum; and a recording controller controlling the emission of laser light from the recording head and displacement of the recording head by the displacer. In response to rotation of the drum, one cycle of scanning by the recording head in the main scanning direction of the recording medium is completed. Each time, the recording controller displaces the recording head in the secondary scanning direction with a displacement amount smaller than the recording width in the secondary scanning direction according to laser light emitted from the plurality of laser emitters.

According to the present invention, excellent results may be obtained in this way, allowing a reduction in recording strength at both edges of the recording head to be prevented and an occurrence of banding in a printed image to be effectively inhibited.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the fauns of the present invention may be embodied in practice.

Hereinafter, embodiments of the present invention are described with reference to the drawings. In the following, as shown in FIG. 1, the main scanning direction is a direction of wrapping a plate P onto a drum 2 (a rotation direction of the drum 2) and the secondary scanning direction is an axial direction of the drum 2 orthogonal thereto (a displacement direction of a recording head 4).

(First Embodiment)

Figure 1:
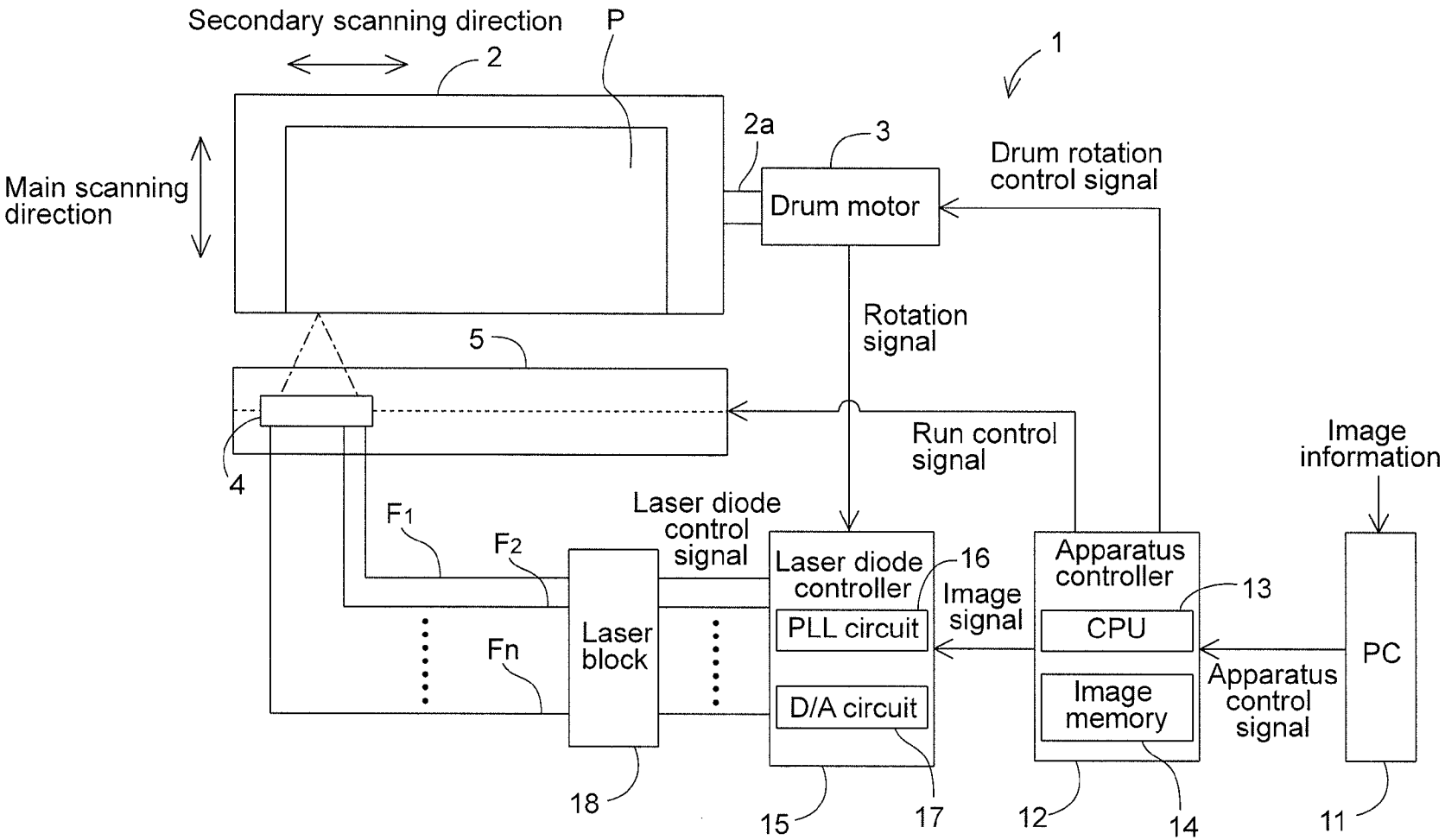
FIG. 1 is a view of the configuration of an image recording apparatus according to an embodiment of the present invention.

FIG. 1 is a structural diagram illustrating a schematic configuration of an image recording apparatus 1 according to an embodiment of the present invention. The image recording apparatus 1 records an image by irradiating laser light onto the plate (recording medium) P being used in the CTP printing. The plate P is configured from a heat-reactive thermal CTP plate, a flexographic plate, and the like, and is fixed in place by a clamping mechanism not shown in the drawings so as to be wrapped around the body of the drum 2, which has a cylindrical shape. In the image recording apparatus 1, an image is recorded on the plate P by a plurality of laser lights emitted from a multi-channel recording head 4, while a rotation axis or shaft 2*a* of the drum 2 is rotatingly driven by a drum motor 3. By intermittently displacing the recording head 4 parallel to the axial direction of the drum 2 with a linear motor (displacer) 5, the recording position of the image on the plate P is sequentially changed.

A PC (personal computer) 11 used as a user operation terminal and subject to control of the recording processing is connected to the image recording apparatus 1 so as to be capable of communicating with the image recording apparatus 1. The PC 11 has installed therein an application program for controlling the image recording apparatus 1 and stores image information, including image data to be recorded on the plate P, and apparatus control information for controlling a recording operation of the image recording apparatus 1. In the image recording apparatus 1, with the rotation of the drum 2, an image for a predetermined line amount in the main scanning direction is recorded onto the plate P by laser light individually emitted from a plurality of semiconductor lasers $LD_1$-$LD_n$ (see FIG. 2, described later). Accordingly, image data corresponding to the number of lines is included in the image information.

The image recording apparatus 1 obtains image information and apparatus control information from the PC 11. In addition, the image recording apparatus 1 includes an apparatus controller (recording controller) 12, a laser diode (LD) controller 15, and a laser block 18. The apparatus controller 12 performs overall control on each component of the image recording apparatus 1 in cooperation with the PC 11 and based on the image information and apparatus control information. The laser diode controller 15 controls emission of the plurality of semiconductor lasers $LD_1$-$LD_n$, which are the light sources for the lasers emitted from the recording head 4. The laser block 18 includes the semiconductor lasers $LD_1$-$LD_n$ and their drivers.

The apparatus controller 12 is chiefly configured with a CPU (Central Processing Unit) 13 performing calculations and controls based on a predetermined control program, and an image memory 14 functioning as a buffer memory storing image information obtained from the PC 11 when appropriate. Further, based on apparatus control information from the PC 11, the apparatus controller 12 outputs to a drive controller (not shown in the drawings) of the drum motor 3 a drum rotation control signal to control the rotation speed of the drum 2. In addition, the apparatus controller 12 outputs to a drive controller (not shown in the drawings) of the linear motor 5 a run control signal to control the running speed of the linear motor 5. Further still, based on image information from the PC 11, the apparatus controller 12 outputs to a laser diode controller 15 an image signal including control information to control the emission of laser light from the recording head 4 (more strictly speaking, the emission of laser light from each of the semiconductor lasers $LD_1$-$LD_n$).

The laser diode controller 15 includes a PLL (Phase Locked Loop) circuit 16 generating a standard clock signal by obtaining a rotation signal from an encoder (not shown in the drawings) attached to the drum motor 3. The laser diode controller 15 then syncs to the standard clock signal and outputs an image signal from the image memory 14 to the fiber output-format laser block 18 through a D/A converter circuit 17 as a laser diode control signal.

The laser block 18 emits laser light from each of the semiconductor lasers $LD_1$-$LD_n$ (see FIG. 2) at an output value and output timing based on the laser diode control signal (electric current). The emitted laser light is then sent to the recording head 4 through respective optical fibers $F_1$-$F_n$.

Figure 2:
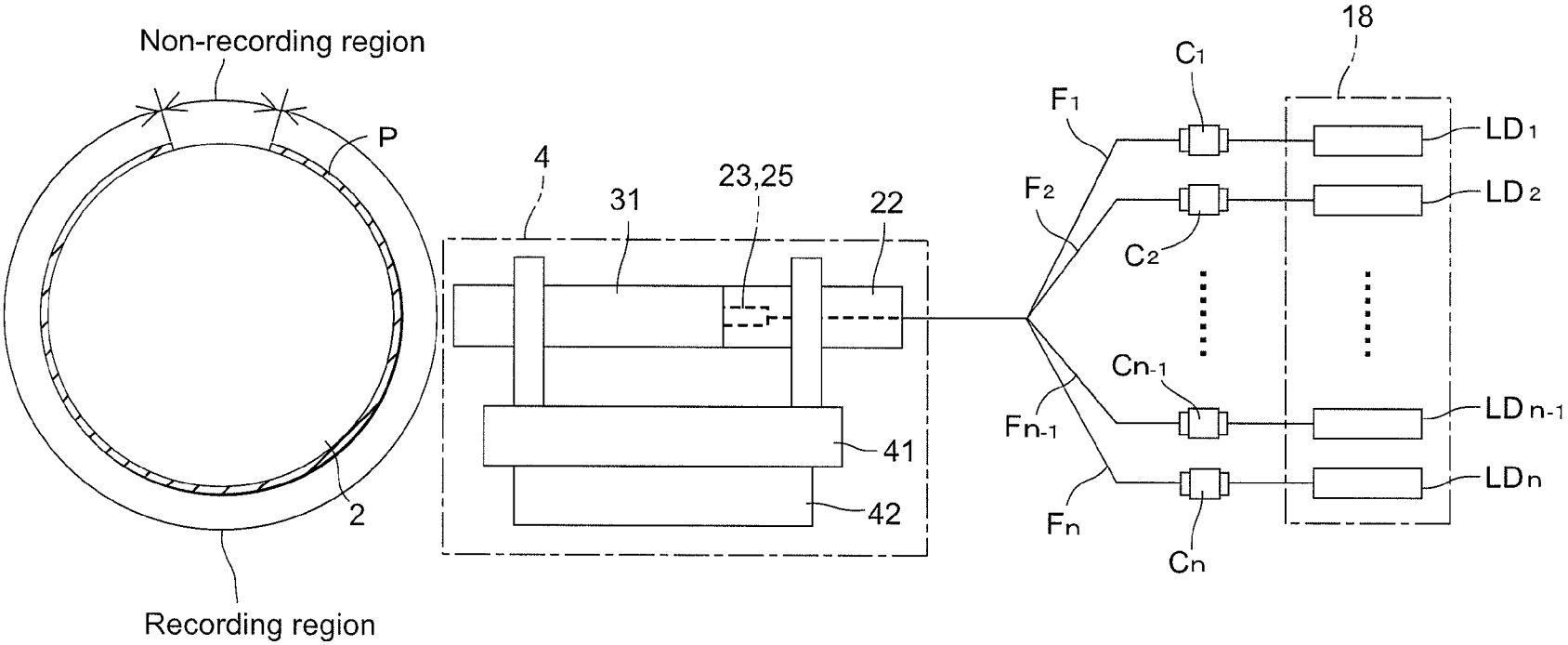
FIG. 2 is a schematic view illustrating details of a configuration in the vicinity of a recording head and a laser block according to the embodiment.
Figure 3:
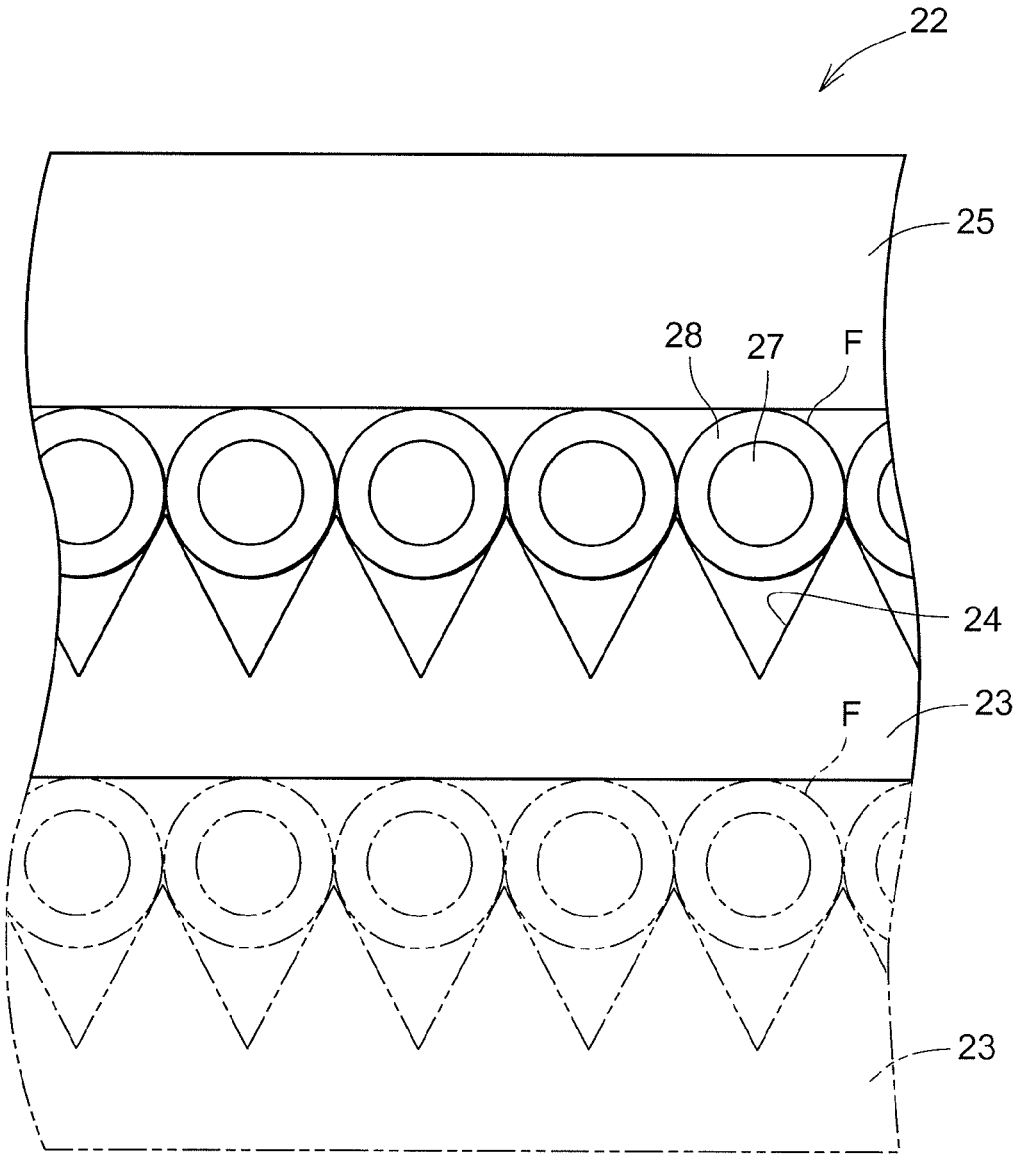
FIG. 3 is a cross-sectional view illustrating the configuration of a fiber array according to the embodiment.
Figure 4:
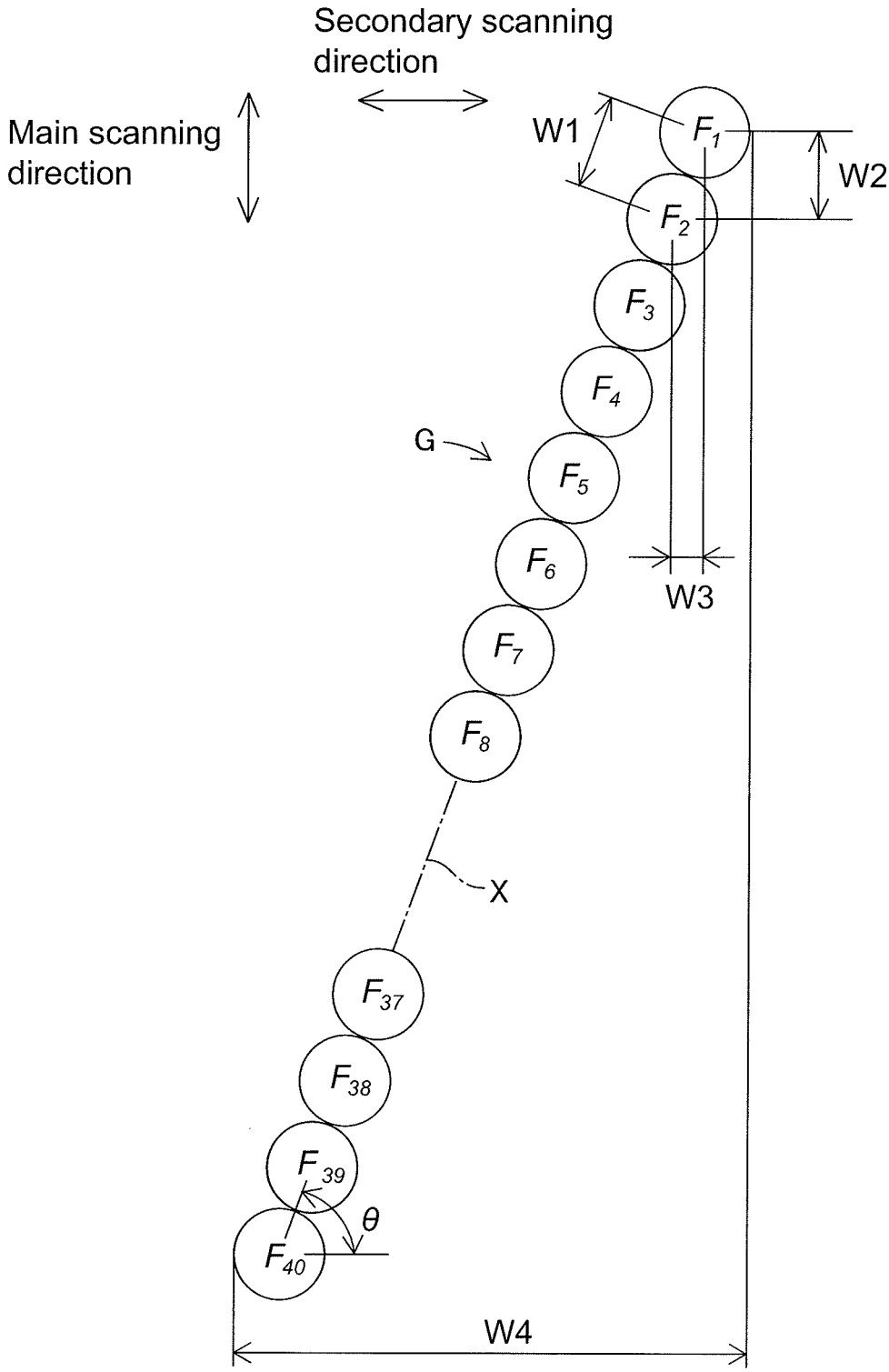
FIG. 4 is a schematic view illustrating an arrangement of a bundle of optical fibers in a laser output in the recording head according to the embodiment.

FIG. 2 is a schematic view illustrating details of a configuration in the vicinity of the recording head 4 and the laser block 18. FIG. 3 is a cross-sectional view illustrating a configuration of a fiber array 22. FIG. 4 is a schematic view illustrating an arrangement of a bundle of optical fibers in a laser output in the recording head 4.

As shown in FIG. 2, the laser block 18 includes the plurality of semiconductor lasers $LD_1$-$LD_n$ (here, as a non-limiting example only, the number of channels n=40). Outputs of the semiconductor lasers $LD_1$-$LD_n$ are each connected to respective individual optical fibers $F_1$-$F_n$ via respective optical connectors $C_1$-$C_n$.

A forefront of each optical fiber $F_1$-$F_n$ is fixed to the fiber array 22 provided to the recording head 4 and is arranged in an array. In the fiber array 22, as shown in FIG. 3, each optical fiber F is fitted into a plurality of V grooves 24 formed on a substrate 23. In addition, each optical fiber F is fixed in place, sandwiched between the substrate 23 and a cover plate 25. Here, as a non-limiting example only, the V grooves 24 have a V shape having a 60° angle, and are formed along an extension direction (left-right direction in FIG. 2) of the optical fibers $F_1$-$F_n$. The substrate 23 and the cover plate 25 are formed, for example, from a fused quartz plate material having a thickness of 50 μm or more. A component having a known configuration may be used as the optical fiber F; however, a central core 27 has a diameter of 60-105 μm and a cladding 28 covering the circumference thereof has a diameter of 125 μm.

With a configuration of this type, the forefronts of the optical fibers $F_1$-$F_n$ are aligned by the V grooves 24 with a high degree of accuracy and the laser emitters configuring the emitting end faces thereof are aligned in a single line at a uniform interval W1, as shown in FIG. 4. Here, when the resolution of a recorded image is, as a non-limiting example only, 2400 dpi, the interval (distance between centers) W1 of adjacent optical fibers is 127 μm. The angle of inclination θ of the alignment direction X with respect to the secondary scanning direction is 75.52°, the alignment direction X being determined by a line linking the centers of the optical fibers $F_1$-$F_n$. Further, an interval W2 of each optical fiber $F_1$-$F_n$ in the main scanning direction is 122.97 μm and an interval W3 in the secondary scanning direction is 31.74 μm.

By changing the angle of inclination θ of the alignment direction X for the optical fibers $F_1$-$F_n$, it is possible to change the interval W2 in the main scanning direction and the interval W3 in the secondary scanning direction. Accordingly, the resolution (recording density) of a recorded image can be easily altered. For example, in a case where the resolution is 2540 dpi in the configuration shown in FIG. 4, a setting can be made such that θ=76.33 (W2=123.39, W3=30). In addition, the arrangement of the optical fibers $F_1$-$F_n$ is not limited to that shown in FIG. 4 and may be arranged in a plurality of lines, as shown in FIG. 5 and discussed hereafter.

Referring once again to FIG. 2, a group of optical lenses 31 configured from a plurality of optical lenses, such as collimator lenses, imaging lenses, and the like, is provided to the front (forwards the plate P direction) of the laser emitters of the optical fibers $F_1$-$F_n$. Each laser light from the optical fibers $F_1$-$F_n$ thus forms an image on an image recording surface of the plate P, which is wrapped around the drum 2, through the group of optical lenses 31 without the optical paths thereof overlapping. The irradiation location of each laser light on the plate P corresponds to a pixel of the image being recorded. Here, as opposed to the interval W3 in the secondary scanning direction (30 μm) for the optical fibers $F_1$-$F_n$ shown in FIG. 4, the interval in the secondary scanning direction of each laser light irradiating the image recording surface of the plate P is reduced (altered by a scaling factor) to one-third the size (10 μm) by the group of optical lenses 31. Similarly, a recording width Wr of the recording head 4 (width in the secondary scanning direction for one bundle of laser light irradiating the plate P) is one-third the size (410 μm) of a width W4 (1230 μm) in the secondary scanning direction of one bundle of optical fibers $F_1$-$F_n$ shown in FIG. 4.

The fiber array 22 and the group of optical lenses 31 are supported on a focusing stage 41, the focusing stage 41 that adjusts the focus of the laser light. Further, the focusing stage 41 is connected to a steering element of the linear motor 5 (see FIG. 1), and is supported on a moving stage 42 movable in the secondary scanning direction along a guide rail not shown in the drawings.

Figure 5:
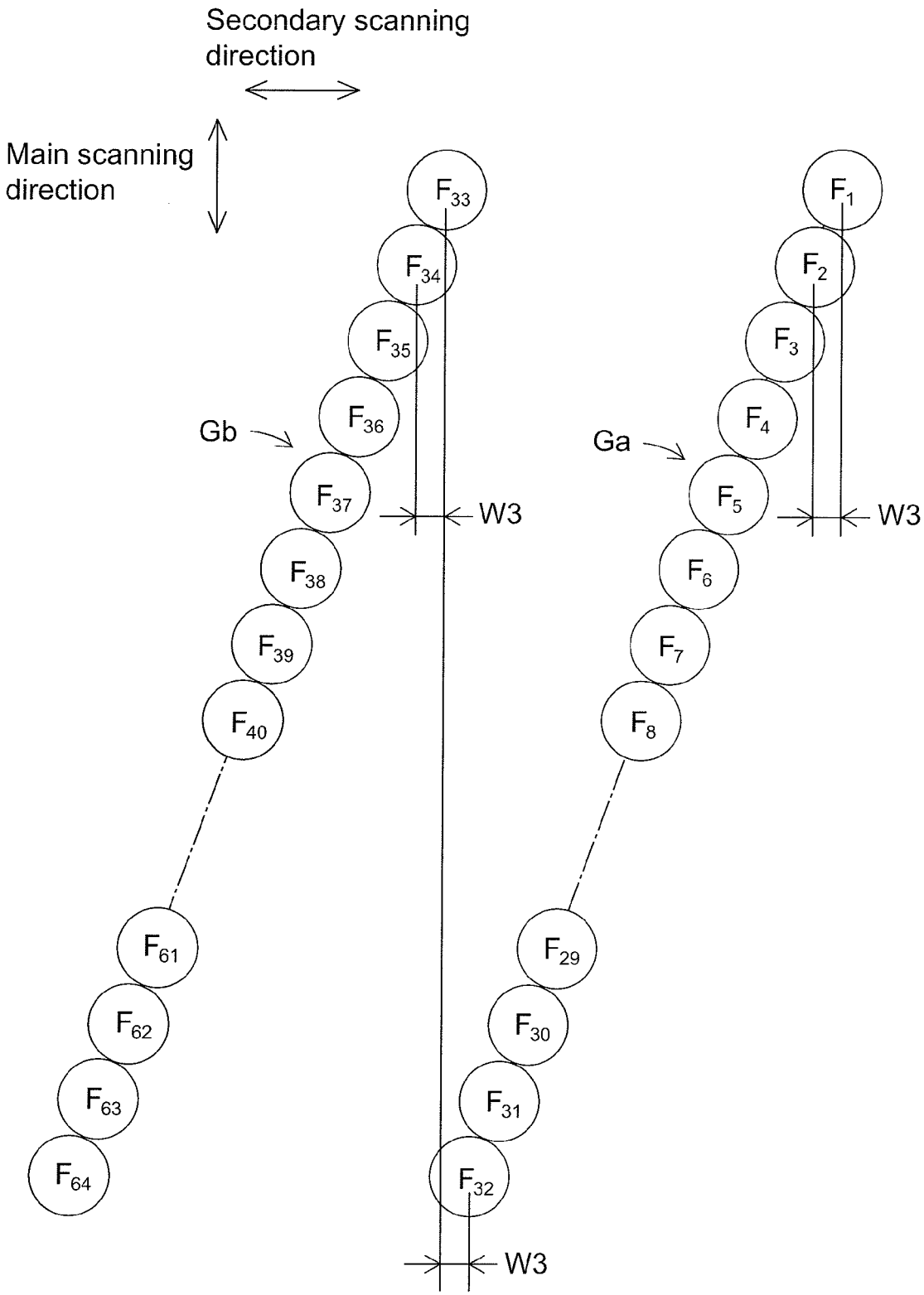
FIG. 5 is a schematic view illustrating an alternate example of the arrangement of the bundle of optical fibers shown in FIG. 4.

FIG. 5 is a schematic view illustrating an alternate example of the arrangement of the bundle of optical fibers $F_1$-$F_n$ shown in FIG. 4. FIG. 5 shows an example in which the forefronts of the optical fibers $F_1$-$F_n$ (here, the number of channels n=64) are arranged in two parallel lines of 32 channels each. The interval W3 in the secondary scanning direction for adjacent optical fibers is 31.74 μm. The interval W3 is similarly set between an optical fiber in channel 32 positioned at the bottom-most portion of a first optical fiber bundle Ga and an optical fiber in channel 33 positioned at the top-most portion of a second optical fiber bundle Gb. The interval in the secondary scanning direction for each laser light irradiating the image recording surface of the plate P is reduced by the group of optical lenses 31 to 10.58 μm. Such an arrangement of optical fibers, as opposed to the configuration shown by the solid lines in FIG. 3, can be implemented by further stacking, on a lower level, the substrate 23 having V grooves 24 in which the optical fibers F are fitted, as shown by the two-dot dashed lines in FIG. 3. Moreover, a configuration in which the optical fibers F and the substrate 23 are stacked on a plurality of lower levels (3 rows or more) is also possible.

Next, the image recording operation in the image recording apparatus 1 of the above-described configuration is described. In the image recording apparatus 1 shown in FIG. 1, image recording is performed by driving the drum 2 to rotate at a predetermined speed and, with the recording head 4 stopped at a predetermined position, emitting laser light from the recording head 4 toward the image recording surface of the plate P.

The laser light of a plurality of channels emitted from the recording head 4 has a predetermined recording width Wr, as described above. By rotating the drum 2 once (that is, one cycle of scanning is performed in the main scanning direction by the recording head 4), an image is recorded in the main scanning direction of the plate P at the recording width Wr. When the recording for one rotation of the drum 2 is complete, the recording head 4 is displaced in the secondary scanning direction to the next recording position by the linear motor 5. Thereafter, the same kind of recording operation is performed next during one rotation of the drum 2. In this way, in the image recording apparatus 1, an image is recorded in all regions of the plate P by repeatedly performing image recording for one rotation of the drum 2 and displacement of the recording head 4 in the secondary scanning direction.

Figure 6A:
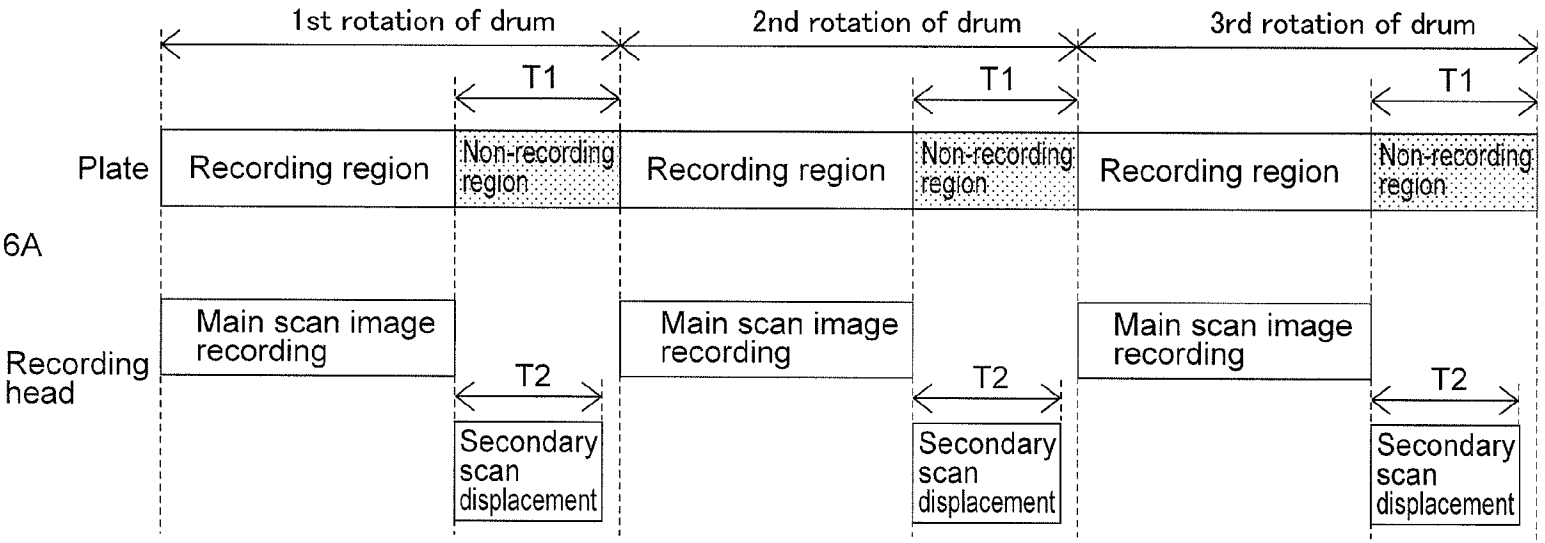
FIGS. 6A and 6B are timing flowcharts illustrating the operation of the image recording apparatus according to the embodiment, FIG. 6A showing a first recording mode and FIG. 6B showing a second recording mode.
Figure 6B:
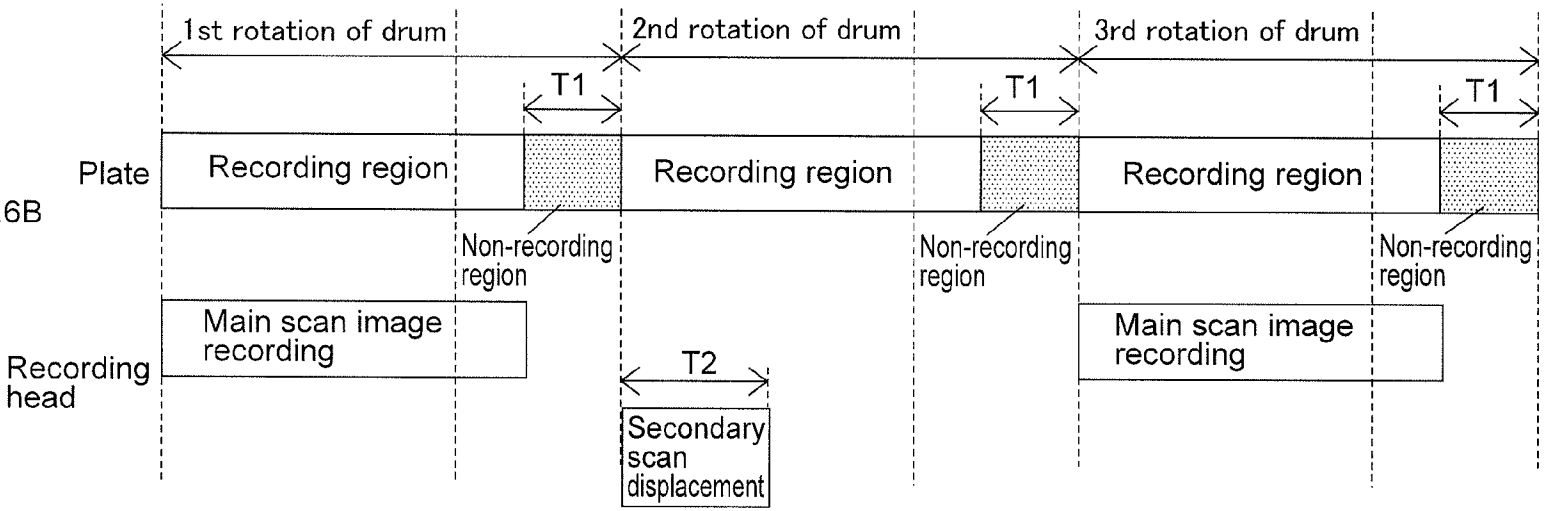

FIGS. 6A and 6B are timing flowcharts illustrating the operation of the image recording apparatus 1. FIG. 6A shows a first recording mode performing image recording and displacement of the recording head 4 during one rotation of the drum 2. FIG. 6B shows a second recording mode in which, after image recording has been performed during one rotation of the drum 2, displacement of the recording head 4 is performed with the next rotation of the drum 2.

As shown in FIG. 2, in the main scanning direction (circumferential direction of the drum 2), the plate P has predetermined recording regions at which an image can be recorded. Meanwhile, a portion where the plate P is not wrapped around the drum 2 (including a clamped portion of the plate P) constitutes a non-recording region where an image is not recorded. A time during which the non-recording region is in an irradiation position of the recording head 4 during rotation of the drum 2 (that is, the imaging location of the laser light passes through the non-recording region) is a time T1. In a case where the time T1 is greater than a displacement time T2 for one cycle of displacement of the recording head 4 in the secondary scanning direction, the first recording mode can be executed. Meanwhile, in a case where the time T1 is less than the displacement time T2 (for example, when the plate P is wrapped around roughly the entire circumference of the drum 2 and the non-recording region is small), the second recording mode can be executed. Moreover, the time T1 changes due to alterations in rotation speed of the drum 2, size of the non-recording region (circumferential direction length), and the like.

As shown in FIG. 6A, in the first recording mode, during the first rotation of the drum 2, image recording is accomplished when the recording region is in an irradiation position of the recording head 4. Thereafter, during the time T1 when the non-recording region is in an irradiation position of the recording head 4, the recording head 4 is displaced in the secondary scanning direction (that is, the time T1≥the time T2). A similar operation is performed during subsequent rotations of the drum 2. In this way, by displacing the recording head 4 in the secondary scanning direction when the non-recording region is in the irradiation position of the recording head 4, a reduction in recording processing speed due to displacement of the recording head 4 can be prevented.

Meanwhile, as shown in FIG. 6B, in the second recording mode, during the first rotation of the drum 2, image recording is performed when the recording region is in the irradiation position of the recording head 4. In the time T1 thereafter during which the non-recording region is in the irradiation position of the recording head 4, the recording head 4 cannot be displaced (that is, the time T1<the time T2) and, thus, during the second rotation of the drum 2, the recording head 4 is displaced in the secondary scanning direction. Image recording and displacement in the secondary scanning direction are repeated alternately in a similar way during subsequent rotations of the drum 2.

During the performance of recording processing, one of the first and second recording modes is selected by a comparison of the time T1 and the time T2. However, when the time T1 changes during recording processing for the same plate P, the first and second recording modes can be selectively performed for each rotation of the drum 2 (for each scan in the main scanning direction).

Figure 7:
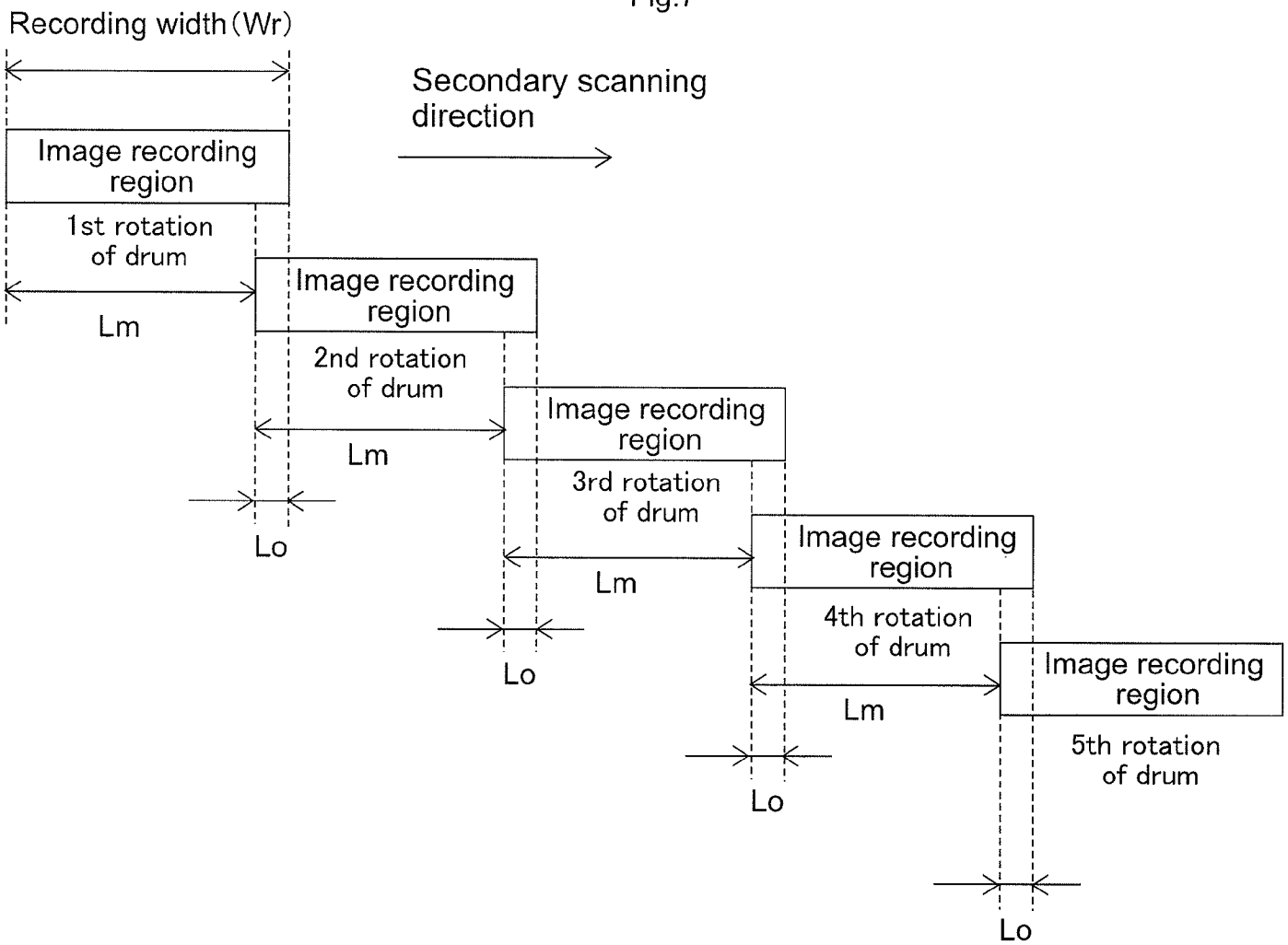
FIG. 7 is an explanatory diagram of a displacement operation of the recording head according to the embodiment.
Figure 8:
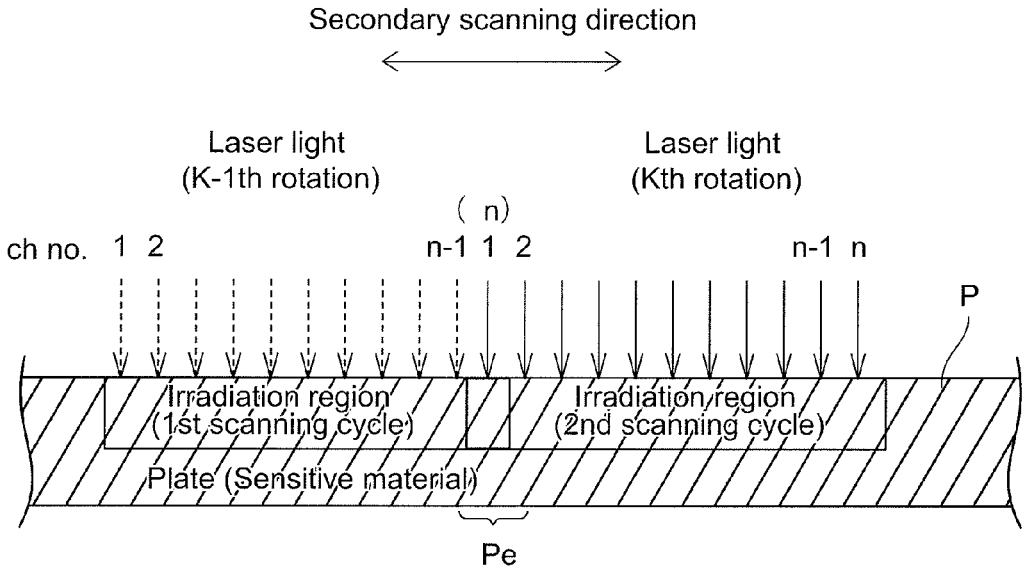
FIG. 8 is an explanatory diagram illustrating laser light irradiation on a plate P according to the embodiment.

FIG. 7 is an explanatory diagram of the displacement operation of the recording head 4. FIG. 8 is an explanatory diagram illustrating laser light irradiation on the plate P. For ease of description, FIG. 7 shows each image recording region which is the target of recording processing shifted in a vertical direction on the paper surface for different rotations of the drum 2. However, each actual image recording region encompasses roughly the entire area of the plate P in the main scanning direction.

As described above, in response to rotation of the drum 2, each time one cycle of image recording by the recording head 4 in the main scanning direction of the plate P (scanning in the main scanning direction) is complete, the recording head 4 is displaced in the secondary scanning direction. As shown in FIG. 7, a displacement amount Lm for the recording head 4 is defined to be less than the recording width Wr. Therefore, a rear edge in the secondary scanning direction of an image recording region (laser irradiation region) during a first rotation of the drum 2 overlaps with a front edge in the secondary scanning direction of the image recording region during a second rotation of the drum 2 with a predetermined overlap width Lo (Wr-Lm). Similarly, even during subsequent rotations of the drum 2, the rear edge in the secondary scanning direction of the image recording region overlaps with a front edge in the secondary scanning direction of the image recording region during the next rotation of the drum 2 with the predetermined overlap width Lo.

Accordingly, when the image recording regions in both a first rotation of the drum 2 and a final rotation in which recording processing is completed are excluded, both edges of all image recording regions overlap with the edge of the adjacent image recording regions with the predetermined overlap width Lo. The overlap width Lo can be set to a desired size by controlling the displacement amount Lm of the linear motor 5. When the overlap width Lo is set to the size of one channel of laser light (here, 10 μm), as shown in FIG. 8, for example, an irradiation position of laser light in channel n during the K-1$^{th}$ rotation of the drum 2 (where K is an integer equal to or greater than 2) overlaps with the irradiation position of laser light in channel 1 during the K$^{th}$ rotation of the drum 2. Thus, it becomes possible to prevent reduction in recording strength at overlapping regions Pe corresponding to both edges of the image recording region. Furthermore, here, the displacement amount Lm (that is, the overlap width Lo) of the recording head 4 is constant; however, it is also possible to change the displacement amount Lm for each rotation of the drum 2.

Figure 9:
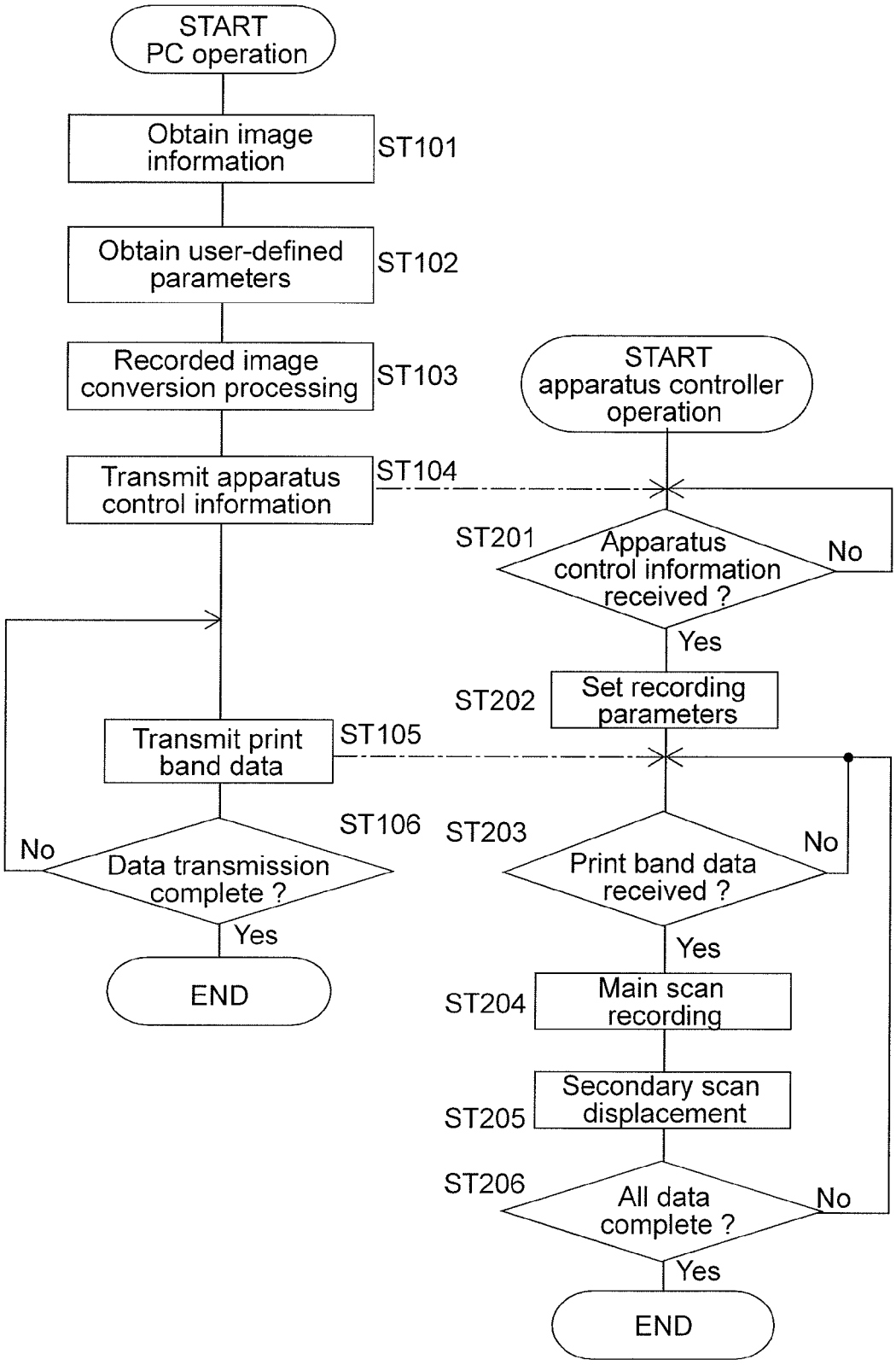
FIG. 9 is a flowchart illustrating the operation of the image recording apparatus according to the embodiment.
Figure 10:
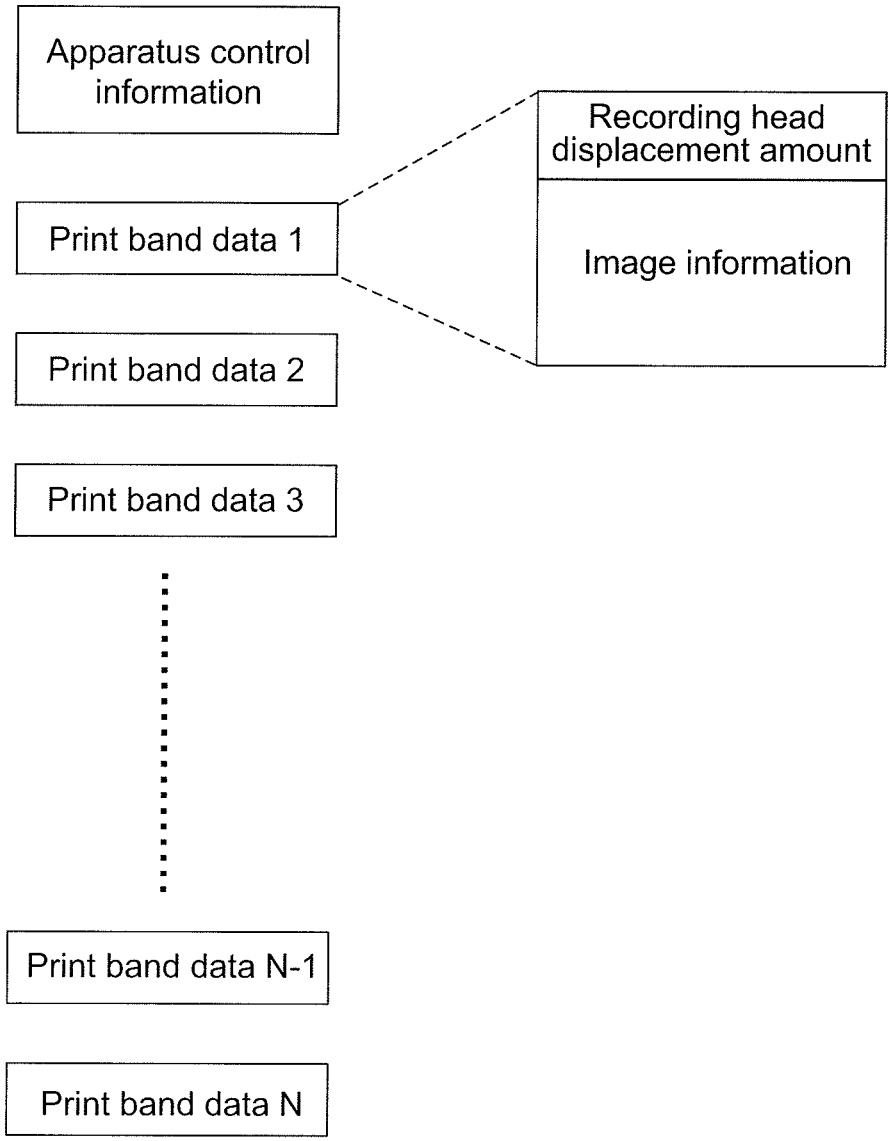
FIG. 10 is an explanatory diagram of control information for the image recording apparatus according to the embodiment.

FIG. 9 is a flowchart illustrating the operation of the image recording apparatus 1. FIG. 10 is an explanatory diagram of control information for the image recording apparatus 1 transmitted from the PC 11.

As shown in FIG. 9, according to an operation by a user, the PC 11 obtains and stores each of image information and user-defined parameters (ST101, ST102). The user-defined parameters include various parameters a user sets on the PC 11 in order to control the recording operation of the image recording apparatus 1 (for example: rotation speed of the drum 2, laser light exposure energy gradient, maximum exposure energy, main scan length (length of line), secondary scan length (number of lines), number of print bands (number of image recording regions formed on the plate P), displacement amount of the recording head 4, and so on). Here, the laser light exposure energy gradient is not limited only to two data values of ON and OFF. When, for example, there are 256 gradients, the laser light exposure energy gradient is recorded as 8 bits of data per pixel. Then, the PC 11 performs recorded image conversion processing and generates a plurality of image information in accordance with the number of print bands, the image information including information for a predetermined line or lines corresponding to the number of channels of laser light emitted from the recording head 4 (ST103).

Next, the PC 11 transmits control information to the image recording apparatus 1. More specifically, and as additionally shown in FIG. 10, apparatus control information including user-defined parameters (here, excluding the displacement amount of the recording head 4) is transmitted to the image recording apparatus 1 (ST104). Then, print band data 1 through N (N being the number of print bands) is generated in which the displacement amount information for the recording head 4 is appended to each piece of image information generated according to the number of print bands. The print band data 1 through N is then transmitted in sequence to the image recording apparatus 1 (ST105). When transmission of all the print band data is complete (ST106: Yes), the operation of the PC 11 ends. In this way, by appending information for the displacement amount of the recording head 4 to each unit of image information, the displacement amount of the recording head 4 can be easily altered for each rotation of the drum 2.

Meanwhile, in the image recording apparatus 1, when apparatus control information is received from the PC 11 (ST201: Yes), the apparatus controller 12 sets recording parameters for controlling each apparatus component based on the apparatus control information (ST202). Thereby, the drum 2, the recording head 4, the linear motor 5, and the like become able to perform predetermined operations based on the user-defined parameters.

Thereafter, the image recording apparatus 1 begins to receive the print band data from the PC 11. When the apparatus controller 12 receives the print band data (ST203: Yes), the print band data is stored as appropriate in an image memory 14. Then, based on the print band data, image recording in the main scanning direction for one rotation of the drum 2 is performed (ST204). Then, when the image recording for one rotation of the drum 2 is complete, displacement of the recording head 4 in the secondary scanning direction is performed (ST205).

At this point, in the apparatus controller 12, based on information for rotation speed of the drum 2 within the print band data, a drum rotation control signal for the drum motor 3 is generated, then, based on information for the amount of displacement of the recording head 4, a running control signal is generated for the linear motor 5, and then, based on the image information, an image signal is generated for the laser diode controller 15.

The steps ST203 to ST205 described above are repeatedly performed until recording processing based on all print band data is completed. Finally, when recording processing for all print band data is completed (ST206: Yes), the operation of the image recording apparatus 1 ends.

In the image recording apparatus 1 described above, each time one cycle of scanning by the recording head 4 is completed in the main scanning direction, the recording head 4 is displaced in the secondary scanning direction by a displacement amount Lm, which is smaller than the recording width Wr in the secondary scanning direction. Thus, there is no need for complex controls on the image recording operation (for example, controlling output of the semiconductor lasers for each channel) and a reduction in recording strength at both edges of the recording head 4 (image recording region) can be prevented. As a result, the occurrence of banding in the printed image can be effectively inhibited.

Further, in the image recording apparatus 1, the linear motor 5 which has excellent displacement speed and positioning accuracy is used to displace the recording head 4 in the secondary scanning direction. Thus, it becomes possible to quickly displace the recording head 4 by the desired displacement amount Lm, which is smaller than the recording width Wr. As a result, it is possible to inhibit a reduction in the recording processing speed, and also to set a desired overlap amount for adjacent recording regions on the plate P. Thus, a reduction in recording strength at both edges of the recording head 4 can be effectively prevented.

(Second Embodiment)

Figure 11:
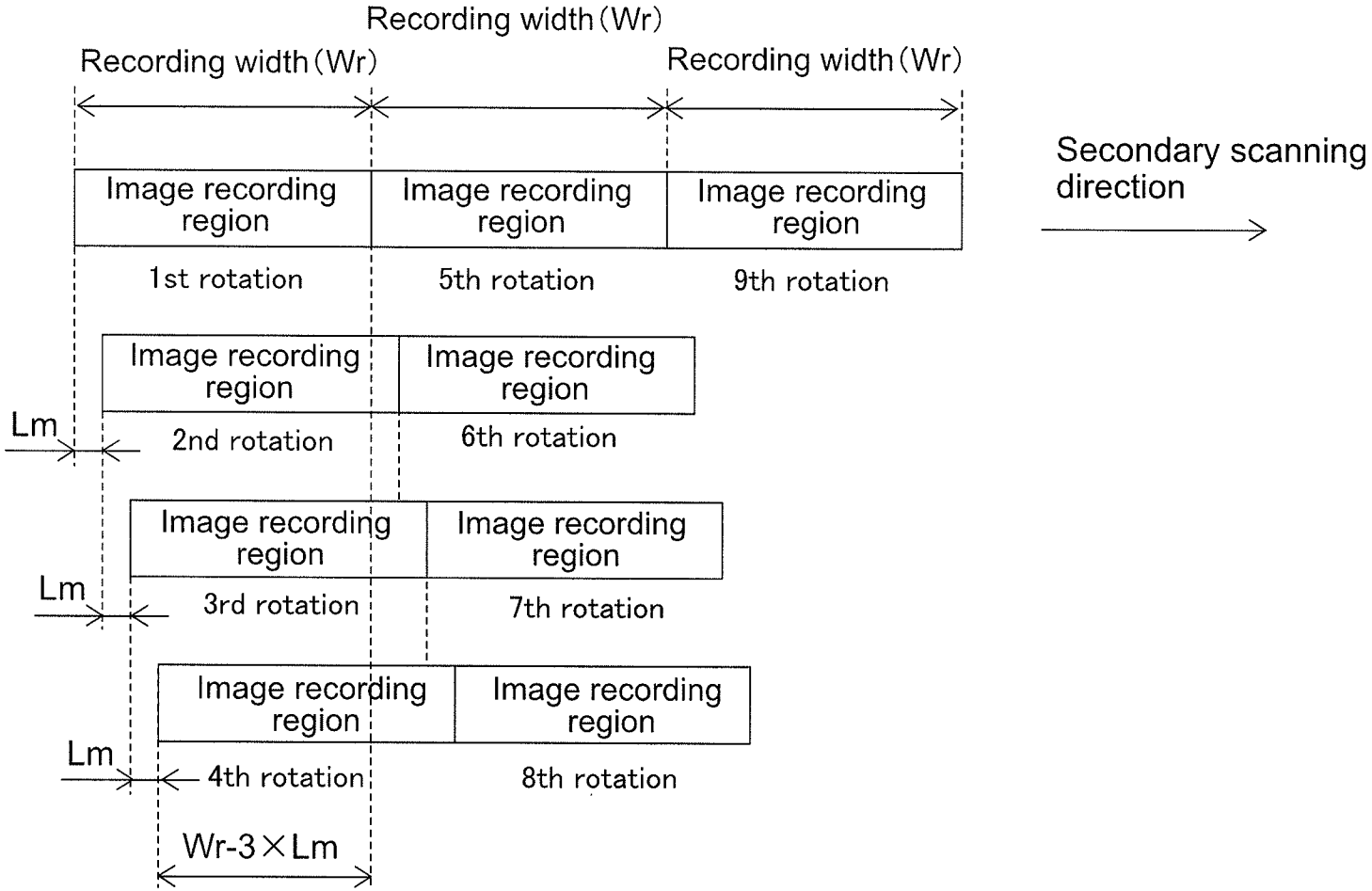
FIG. 11 is an explanatory diagram of a displacement operation of the recording head in the image recording apparatus according to another embodiment of the present invention.
Figure 12:
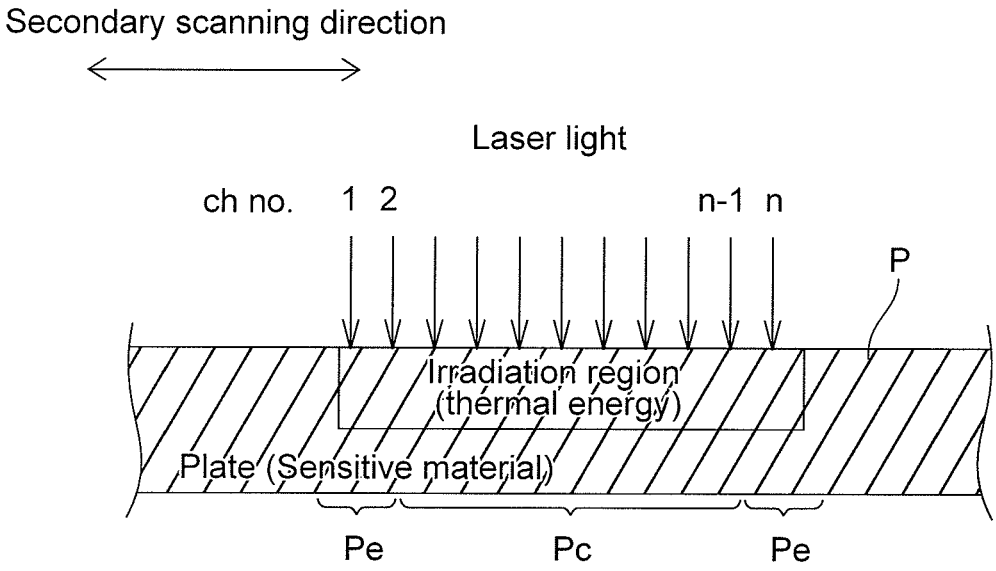
Fig.12 Prior Art
FIG. 12 is an explanatory diagram illustrating a form of light exposure for the plate P in the conventional art.

FIG. 11 is an explanatory diagram of the displacement operation of the recording head 4 in the image recording apparatus 1 according to another embodiment of the present invention, and corresponds to FIG. 7 for the above-described embodiment. The image recording apparatus 1 according to the second embodiment is similar to the first embodiment excepting those aspects relating to operation which are described particularly hereafter. A detailed description of other aspects is omitted.

In the image recording apparatus 1 according to the second embodiment, an aspect in which image recording for one rotation of the drum 2 and displacement of the recording head 4 in the secondary scanning direction are repeatedly performed is similar to the first embodiment. However, the displacement operation differs. In the second embodiment, a first displacement operation and a second displacement operation are alternately performed repeatedly. Across a range where the cumulative total of the displacement amount of the recording head 4 is less than the recording width thereof, a first displacement operation intermittently displaces the recording head 4 in the secondary scanning direction a plurality of times and, subsequent to this first displacement operation, a second displacement operation displaces the recording head 4 in the secondary scanning direction only a distance obtained by subtracting a cumulative total of the displacement amount from the recording width.

For example, as shown in FIG. 11, in the first displacement operation of the image recording apparatus 1, when Lm is a displacement amount of the recording head 4 in the secondary scanning direction after completion of the recording processing for one rotation of the drum 2, the image recording region for the second rotation of the drum 2 is a position shifted only Lm in the secondary scanning direction with respect to the image recording region for the first rotation of the drum 2. Next, the position of the image recording region for the third rotation of the drum 2 with respect to the image recording region for the second rotation, and the position of the image recording region for the fourth rotation of the drum 2 with respect to the image recording region of the third rotation, are positions similarly shifted only Lm.

Here, a case is shown in which the recording head 4 is displaced intermittently three times in the secondary scanning direction in the first displacement operation. However, the displacement amount Lm and the number of times the recording head 4 is displaced can be set as desired. However, the displacement amount Lm and the number of displacement cycles of the recording head 4 must be set such that the cumulative total of the displacement amount of the recording head 4 in the first displacement operation (here, 3×Lm) will be a value less than the recording width Wr. Furthermore, the displacement amounts Lm in the first displacement operation do not necessarily need to all be identical.

In the second displacement operation of the image recording apparatus 1 which is executed next, after the image recording for the fourth rotation of the drum 2 is completed, the recording head 4 is displaced in the secondary scanning direction only the distance obtained by subtracting a cumulative total of the amount of displacement from the recording width Wr (Wr-3×Lm). Thereby, the left edge position of the image recording region during the fifth rotation of the drum 2 matches the right edge position of the image recording region during the first rotation of the drum 2. Thereafter, after the image recording for the fifth through seventh rotations of the drum 2, the first displacement operation is performed once more similarly to the second through fourth rotations described above. The second displacement operation is performed once more after the image recording of the eighth rotation.

In the second embodiment, scanning is performed a plurality of times in the main scanning direction while shifting the position of the recording head 4 in the secondary scanning direction. Accordingly, it becomes possible to prevent a reduction in the recording strength on both edges of the recording head 4 (both edges of the image recording region) and to increase the recording strength in roughly all regions of the plate P.

The present invention was described with reference to particular embodiments; however, these embodiments are merely examples and are not intended to limit the present invention. For example, the number of channels for laser emitters (emitting ends of optical fibers) in the recording head and their arrangement can be altered in many ways. Further, the above-described embodiments are configured so as to necessarily displace a recording head in the secondary scanning direction each time a drum rotates. However, the recording head is not necessarily excluded from performing recording processing for a plurality of rotations of the drum at the same position. Furthermore, a plurality of laser emitters may be aligned parallel to the secondary scanning direction (angle of inclination $\theta=0$). Further still, all structural elements of the image recording apparatus according to the present invention and shown in the above-described embodiments are not necessarily required in their entirety, and may be selectively included or discarded as appropriate so long as such inclusion or discarding does not depart from the scope of the present invention.

The image recording apparatus according to the present invention does not require complex controls for operations to record an image. By preventing a reduction in recording strength at both edges of a recording head, it is possible to effectively inhibit the occurrence of banding in a printed image. The present invention is useful as an image recording apparatus performing image recording by irradiating laser light onto a recording medium, such as a plate wrapped around a drum.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

What is claimed is:

1. An image recording apparatus performing image recording by irradiating laser light onto a heat-reactive recording medium wrapped around a drum, comprising:

a recording head coupled to a plurality of laser emitters provided in a line and emitting laser light;

a displacer displacing the recording head in a secondary scanning direction intersecting with a main scanning direction in which the recording medium is wrapped around the drum; and a recording controller controlling the emission of laser light from the recording head and displacement of the recording head by the displacer, wherein in response to a rotation of the drum, one cycle of scanning by the recording head in the main scanning direction of the recording medium is completed and each time, the recording controller displaces the recording head in the secondary scanning direction with a displacement amount smaller than a recording width in the secondary scanning direction according to laser light emitted from the plurality of laser emitters, wherein the plurality of laser emitters are arranged in a plurality of lines inclined with respect to the secondary scanning direction.

2. The image recording apparatus according to claim 1, wherein the displacer comprises a linear motor.

3. The image recording apparatus according to claim 1, wherein the displacer intermittently displaces the recording head in the secondary scanning direction.

4. The image recording apparatus according to claim 1, wherein the drum has a non-recording region defined by a predetermined length in the circumferential direction.

5. The image recording apparatus according to claim 4, wherein the recording controller performs image recording and displacement of the recording head in the secondary scanning direction during one rotation of the drum.

6. The image recording apparatus according to claim 5, wherein the recording controller displaces the recording head in the secondary scanning direction when the non-recording region is in an irradiation position of the recording head.

7. The image recording apparatus according to claim 1, wherein the recording controller intermittently displaces the recording head a plurality of times in the secondary scanning direction across a range where a cumulative total of the displacement amount is less than the recording width.

8. The image recording apparatus according to claim 7, wherein the recording controller displaces the recording head in the secondary scanning direction by a distance obtained by subtracting the cumulative total of the displacement amount from the recording width.

9. The image recording apparatus according to claim 1, wherein fronts of a plurality of optical fibers are fixed to the recording head, opposite ends of the plurality of optical fibers being fixed to the laser emitters to transmit laser light from the laser emitters to the recording head.

10. The image recording apparatus according to claim 9, wherein the fronts of the optical fibers are sandwiched between a substrate and a cover plate.

11. The image recording apparatus according to claim 10, wherein the fronts of the optical fibers are fitted into grooves formed on the substrate.

12. The image recording apparatus according to claim 9, wherein the optical fibers are connected to semiconductor lasers comprising the laser emitters.

13. The image recording apparatus according to claim 11, wherein the grooves are V-shaped.

14. The image recording apparatus according to claim 1, wherein the plurality of lines extend parallel to each other.

15. The image recording apparatus according to claim 1, wherein a spacing between adjacent laser emitters, in the secondary scanning direction, is equal to a spacing between a last laser emitter of a first of said plurality of lines and a first laser emitter of a second of said plurality of lines, in the secondary scanning direction.

16. The image recording apparatus according to claim 1, wherein each of the laser emitters are connected to an optical fiber, ends of the optical fibers are fixed to the recording head and are sandwiched between a substrate and a cover plate or between two substrates.

17. An image recording apparatus performing image recording by irradiating laser light onto a heat-reactive recording medium wrapped around a drum, comprising:

a recording head coupled to a plurality of laser emitters provided in a line and emitting laser light;

a displacer displacing the recording head in a secondary scanning direction intersecting with a main scanning direction in which the recording medium is wrapped around the drum; and a recording controller controlling the emission of laser light from the recording head and displacement of the recording head by the displacer, wherein in response to a rotation of the drum, one cycle of scanning by the recording head in the main scanning direction of the recording medium is completed and each time, the recording controller displaces the recording head in the secondary scanning direction with a displacement amount smaller than a recording width in the secondary scanning direction according to laser light emitted from the plurality of laser emitters, wherein the recording controller performs image recording during one rotation of the drum and the recording controller performs displacement of the recording head in the secondary scanning direction during a next rotation of the drum.

18. An image recording apparatus performing image recording by irradiating laser light onto a heat-reactive recording medium wrapped around a drum, comprising:

a recording head coupled to a plurality of laser emitters provided in a line and emitting laser light;

a displacer displacing the recording head in a secondary scanning direction intersecting with a main scanning direction in which the recording medium is wrapped around the drum; and a recording controller controlling the emission of laser light from the recording head and displacement of the recording head by the displacer, wherein in response to a rotation of the drum, one cycle of scanning by the recording head in the main scanning direction of the recording medium is completed and each time, the recording controller displaces the recording head in the secondary scanning direction with a displacement amount smaller than a recording width in the secondary scanning direction according to laser light emitted from the plurality of laser emitters, wherein the drum has a non-recording region defined by a predetermined length in the circumferential direction, wherein, when a time during which the non-recording region is located at a recording position of the recording head is greater than a time for displacement of the recording head in the secondary scanning direction, image recording and recording head displacement are performed during each rotation of the drum, and when the time during which the non-recording region is located at the recording position of the recording head is less than the time for displacement of the recording head in the secondary scanning direction, image recording and recording head displacement are performed during alternate rotations of the drum.

19. An image recording apparatus performing image recording by irradiating laser light onto a heat-reactive recording medium wrapped around a drum, comprising:

a recording head coupled to a plurality of laser emitters provided in a line and emitting laser light;

a displacer displacing the recording head in a secondary scanning direction intersecting with a main scanning direction in which the recording medium is wrapped around the drum; and a recording controller controlling the emission of laser light from the recording head and displacement of the recording head by the displacer, wherein each time one cycle of scanning by the recording head in the main scanning direction of the recording medium is completed in response to a rotation of the drum, the recording controller displaces the recording head in the secondary scanning direction such that a rear edge of an image recording region in the secondary scanning direction overlaps with a front edge of an adjacent image recording region in the secondary scanning direction.

* * * * *